US005137477A

United States Patent [19]

Wright

[11] Patent Number: 5,137,477

[45] Date of Patent: Aug. 11, 1992

[54] ANTENNA CONNECTOR

[75] Inventor: John O. Wright, York, Pa.

[73] Assignee: GTE Products Corporation, Stamford, Conn.

[21] Appl. No.: 716,412

[22] Filed: Jun. 17, 1991

[51] Int. Cl.[5] ..... H01R 13/00

[52] U.S. Cl. ..... 439/825; 439/848

[58] Field of Search ..... 439/818, 823, 825, 848

[56] References Cited

U.S. PATENT DOCUMENTS 1,334,084 3/1920 Dorsey ..... 439/825

1,835,000 12/1931 Berthold ..... 439/848

*Primary Examiner*—Joseph H. McGlynn

*Attorney, Agent, or Firm*—William H. McNeill

[57] ABSTRACT

A male connector body for a radio antenna employs a plurality of compressible ribs to provide tactile feedback to an assembler. The ribs provide an insertion force that is less than a withdrawal force.

3 Claims, 1 Drawing Sheet

ANTENNA CONNECTOR

TECHNICAL FIELD

This invention relates to connectors and more particularly to antenna connectors. Still more particularly, the invention relates to a male antenna connector which provides tactile feedback to an assembler.

BACKGROUND ART

Antenna connectors for antenna cables, such as those employed in the auto industry for radios usually are provided with some form of locking means for retaining a male connector cable end in a female antenna socket. In the past such means have comprised circumferentially symmetrical ribs or locking tongues. The symmetrical ribs provide no tactile feedback differential to an assembler and the locking tongues make removal very difficult.

DISCLOSURE OF THE INVENTION

It is, therefore, an object of the invention to obviate the disadvantages of the prior art.

It is another object of the invention to enhance antenna connectors.

Yet another object is the provision of an antenna connector which provides tactile feedback to an assembler.

These objects are accomplished, in one aspect of the invention, by the provision of a male connector body which comprises at least an insertion end which is formed to provide means for giving tactile feedback to an assembler when the male body is mated with a female connector body. The feedback means provides an insertion force which is less than a withdrawal force. This connector is a great help to assemblers who can tell, solely by the tactile feedback, when the connector is properly mated. Since installation is usually "blind"; i.e., done by feel, the tactile feedback is a distinct advantage over the prior art connectors.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
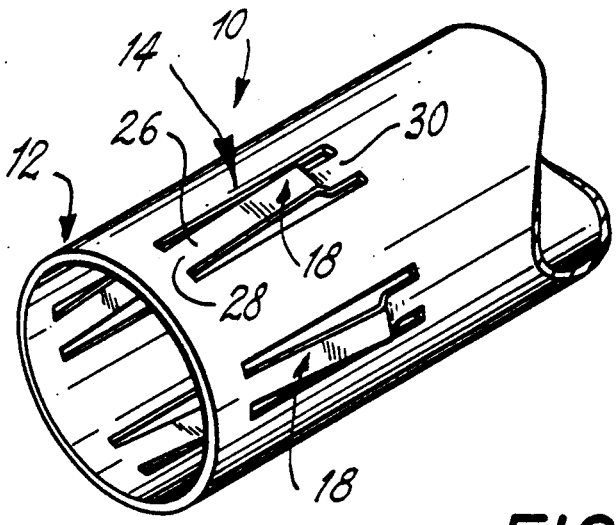
FIG. 1 is a perspective view of an embodiment of the invention.
Figure 2:
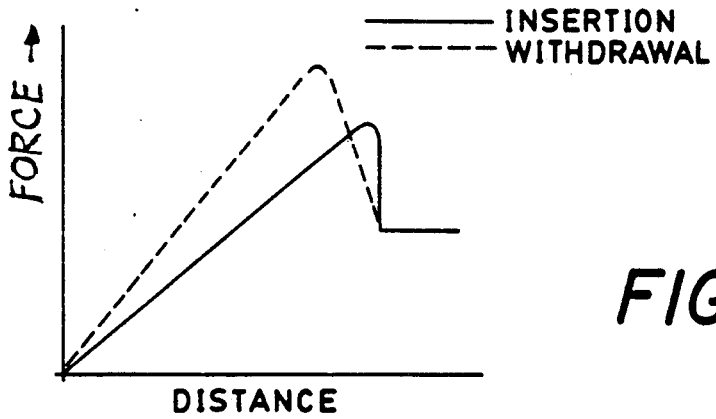
FIG. 2 is a schematic graph of the force requirements.

Referring now to the drawings with greater particularity, there is shown in FIG. 1 a male connector body 10 which has at least an insertion end 12 which is formed to provide means 14 for giving tactile feedback to an assembler when the insertion end 12 is mated with a female connector body 16. The feedack means 14 provides an insertion force for mating which is less than a withdrawal force for unmating. The feedback means 14 comprises a plurality of circumferentially spaced, compressible ribs 18 which are arrayed parallel to the longitudinal axis 20 of the male body 10.

The male body 10 is tubular and has a wall 22 of a given thickness. To provide increased control of the insertion force, the ribs 18 may have a thickness 24 that is less than that of the tubular wall 22. The decreased thickness of the ribs can be provided during the manufacture of the body, as by coining or skiving.

Figure 3:
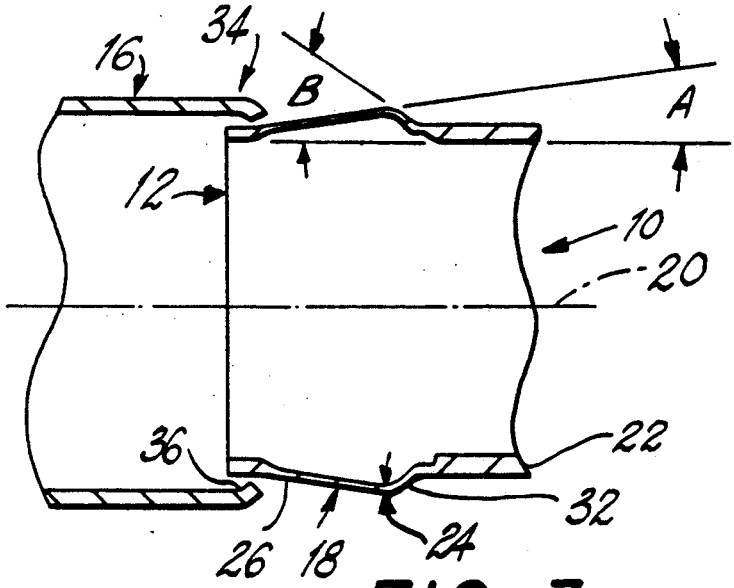
FIG. 3 is an elevational, sectional view of a male connector of the invention about to be mated with a female connector.

In cross-section, as is shown in FIG. 3, the ribs 18 have the appearance of the two short sides of a scalene triangle, with the longest side 26 facing forward, i.e., toward the female connector body 16. The ribs 18 have two ends, 28 and 30, respectively, and each of these ends is integrally connected to the male body 10.

The longest sides 26 make an angle A with the horizontal and the short sides make an angle B with the horizontal. Angle A is between about 7 to 12 degrees and preferably is about 9.5 degrees. Angle B is between about 42 to 46 degrees and preferably is about 44 degrees. A preferred material for the connector body is 70/30 Brass (CDA-260). CDA stands for the Copper Development Association Inc.

Utilizing the preferred material and the preferred angles, and with the ribs having a thickness of about 0.009 inches, the respective insertion force and withdrawal force are 13 pounds and 18 pounds.

The second end of the male connector body is not shown but is generally formed to accommodate a suitable cable, by any known means.

As will be seen in FIG. 3, the female connector body 16 has a male connector body receiving end 34 provided with an inwardly projecting flange 36 which, upon completion of the mating, seats against the short sides 32 of the ribs 18. This connection provides a firm, yet releasable grip on the male connector body 10.

While there have been shown and described what are at present considered to be the preferred embodiments of the invention, it will be apparent to those skilled in the art that various changes and modifications can be made herein without departing from the scope of the invention as defined by the appended claims.

I claim:

1. A male connector body comprising: at least an insertion end formed to provide means for giving tactile feedback when mated with a female connector body, said feedback means providing an insertion force which is less than a withdrawal force, said feedback means comprising a plurality of compressible ribs; said body being tubular and having a given thickness and having a longitudinal axis, said ribs being arrayed parallel to said longitudinal axis, said body having a circumference and said ribs being substantially evenly spaced thereabout and having a thickness less than said given thickness.

2. The male connector body of claim 1 wherein said ribs, in cross-section, have the appearance of the two short sides of a scalene triangle, with the longest of the sides facing forward.

3. The male connector body of claim 2 wherein said ribs have two ends, each end being integrally connected to said body.

* * * * *